US010814239B1

(12) United States Patent
Allard

(10) Patent No.: US 10,814,239 B1
(45) Date of Patent: Oct. 27, 2020

(54) SYSTEM AND METHOD OF USE FOR SELF-SEALING BALLOON

(71) Applicant: Gerald T. Allard, Lynnwood, WA (US)

(72) Inventor: Gerald T. Allard, Lynnwood, WA (US)

( * ) Notice: Subject to any disclaimer, the term of this patent is extended or adjusted under 35 U.S.C. 154(b) by 0 days.

(21) Appl. No.: 16/790,602

(22) Filed: Feb. 13, 2020

(51) Int. Cl.
*A63H 27/10* (2006.01)

(52) U.S. Cl.
CPC ..... *A63H 27/10* (2013.01); *A63H 2027/1033* (2013.01); *A63H 2027/1041* (2013.01); *A63H 2027/1083* (2013.01)

(58) Field of Classification Search
CPC ..... A63H 27/10; A63H 2027/1033; A63H 2027/1041; A63H 2027/1083
USPC ..... 446/220, 221, 222, 224
See application file for complete search history.

(56) References Cited

U.S. PATENT DOCUMENTS 3,871,422 A * 3/1975 Elson ..... F16K 15/20 137/231
4,167,204 A * 9/1979 Zeyra ..... A63B 41/12 137/231
4,674,532 A * 6/1987 Koyanagi ..... A63H 27/10 137/512.15
4,681,138 A * 7/1987 Giuliani ..... A63H 27/10 137/516.29
4,701,148 A * 10/1987 Cotey ..... A63H 27/10 137/223
5,165,393 A * 11/1992 Kawaguchi ..... A63B 23/18 128/200.24
5,245,991 A * 9/1993 Kawaguchi ..... A63B 23/18 128/200.24
5,496,203 A * 3/1996 Murray ..... A63H 27/10 446/221
6,314,984 B1 * 11/2001 Barriendos ..... F16K 15/205 137/223
6,471,621 B2 * 10/2002 Horstel ..... A63B 23/032 128/860
6,790,120 B1 * 9/2004 Murray ..... A63H 27/10 446/220
6,814,644 B2 * 11/2004 Nelson ..... A63H 27/10 446/221
6,863,261 B2 * 3/2005 Swan ..... B29C 45/0055 251/356
7,344,267 B2 * 3/2008 Carito ..... A63H 27/10 362/189
7,478,779 B2 * 1/2009 Nguyen ..... F21V 3/023 244/24
7,850,328 B2 * 12/2010 Carito ..... A63H 27/10 362/184
8,292,454 B2 * 10/2012 Schrimmer ..... A63H 27/10 362/184
8,512,091 B2 * 8/2013 Nelson ..... A63H 27/10 446/220

(Continued)

*Primary Examiner* — Alexander R Niconovich
(74) *Attorney, Agent, or Firm* — Christopher Mayle; Thomas E. LaGrandeur; Bold IP, PLLC

(57) ABSTRACT

A system and method for a self-sealing balloon valve having an umbrella valve insert capable of being filled by any individual with small amounts of pressure applied against the insert, the valve removably positioned and secured inside the neck of a balloon whereby the valve allows for one way air flow thus maintaining the air inside of the balloon for prolonged periods of time as well as maintains the valve in the neck of the balloon.

10 Claims, 3 Drawing Sheets

(56) References Cited

U.S. PATENT DOCUMENTS

| | | | | |
|---|---|---|---|---|
| 9,192,872 | B2 * | 11/2015 | Hakam | A63H 27/10 |
| 9,498,734 | B2 * | 11/2016 | Bo Stieler | A63H 33/22 |
| 9,731,213 | B2 * | 8/2017 | Laden | A63H 27/10 |
| 9,962,619 | B2 * | 5/2018 | Mowbray | A63H 27/10 |
| 2008/0254710 | A1 * | 10/2008 | Nelson | B63C 9/24 446/224 |

* cited by examiner

SYSTEM AND METHOD OF USE FOR SELF-SEALING BALLOON

FIELD OF DISCLOSURE

The field of disclosure is generally directed to a valve and more particularly a self-sealing, refillable balloon valve suitable for inflatable assembly with balloons.

BACKGROUND

Balloons can provide hours of fun and learning for children. Children are drawn to the vivid colors and they are easier than a ball to throw and catch, which can be safer while playing indoors. Playing with a balloon can also be a great way to get rid of excess energy and relieve feelings of stress and tension helping a child's emotional development. The balloon industry has been developing self-sealing balloons with valve mechanisms for ease of valve fabrication and simplicity of incorporation into the balloon stem and body. Many different types of valves have been used but each suffer from one or more disadvantages.

Commonly used balloon valves have a piston valve design but encounter problems with sticking, not allowing for air to properly flow through, making it harder to inflate. Younger children who are the target audience for devices such as these also have a harder time blowing the piston valve open because they cannot generate enough air pressure to get the balloon to inflate. Other valves can only receive helium from connected helium tank cylinders and cannot be blown up by exhalation.

Thus exists a need for a product better designed for children to inflate a balloon without the trouble and awkwardness of trying to wrap ones mouth around the balloon opening while also maintaining air inside the balloon such that there is no reason to tie the end of the balloon. We all know how that goes especially for the little ones. These balloons allow for hours of fun for the little ones as they do not need an adult to help inflate and tie them off.

SUMMARY

The disclosure presented herein relates to a balloon valve system, comprising: a balloon having a neck at the distal end of the balloon; and a valve, the valve comprising an elastic cap having a sealing surface, the valve having an upper cylindrical portion and a lower cylindrical portion, the upper cylindrical portion having an air outlet on an upper surface of the upper cylindrical portion, the lower cylindrical portion having an air inlet on a lower surface of the lower cylindrical portion, the valve having an interior chamber extending between the upper cylindrical portion and the lower cylindrical portion configured so air passes through the air inlet to the air outlet, the lower cylindrical portion of a smaller diameter than the upper cylindrical portion, the upper cylindrical portion having a flanged surface positioned in the interior chamber, the sealing surface resting upon the flanged surface, the lower cylindrical portion having an arcuately-shaped end component, the arcuately-shaped end component extending downward past a lower surface of the lower cylindrical portion, an aperture formed between the arcuately-shaped end component and the lower surface of the lower cylindrical portion, a string, the string configured to pass through the recess wherein the length passed through the recess is tied into a knot, a cover piece, the cover piece having a protrusion, the protrusion configured to be received on an indent on an inner surface of the upper cylindrical portion wherein the cover piece is snap fit onto the upper cylindrical portion, the cover pierce having a disc shaped component with a series of holes passing through the disc shaped component, the upper cylindrical portion having an edge portion extending downward past a lower surface of the upper cylindrical portion, forming a recess, the neck of the balloon configured to be stretched over the edge portion with a portion of the neck stored in the recess.

The disclosure presented herein also relates to a method for using self-sealing valve with a balloon, the method comprising: positioning a valve inside a neck of a balloon; the valve comprising an elastic cap having a sealing surface, the valve having an upper cylindrical portion and a lower cylindrical portion, the lower cylindrical portion of a smaller diameter than the upper cylindrical portion, the upper cylindrical portion having an air outlet on an upper surface of the upper cylindrical portion, the lower cylindrical portion having an air inlet on a lower surface of the lower cylindrical portion, the valve having an interior chamber extending between the upper cylindrical portion and the lower cylindrical portion configured so air passes through the air inlet to the air outlet, the upper cylindrical portion having a flanged surface positioned in the interior chamber, the sealing surface resting upon the flanged surface, the upper cylindrical portion having an edge portion extending downward past a lower surface of the upper cylindrical portion, forming a recess, stretching the neck of the over the edge portion wherein a portion of the neck upstretched becoming stored in the recess, exhaling into the air inlet, passing a string through an aperture on the valve, the aperture formed between the arcuately-shaped end component and the lower surface of the lower cylindrical portion, the arcuately-shaped end component extending downward past the lower surface of the lower cylindrical portion; tying the string into a knot, connecting a cover piece to upper cylindrical portion, the cover piece having a protrusion, the protrusion received by an indent on an inner surface of the upper cylindrical portion.

The disclosure presented herein also relates to a balloon valve system, comprising: a valve, the valve comprising an elastic cap having a sealing surface, the valve having an upper cylindrical portion and a lower cylindrical portion, the upper cylindrical portion having an air outlet on an upper surface of the upper cylindrical portion, the lower cylindrical portion having an air inlet on a lower surface of the lower cylindrical portion, the valve having an interior chamber extending between the upper cylindrical portion and the lower cylindrical portion configured so air passes through the air inlet to the air outlet, the lower cylindrical portion of a smaller diameter than the upper cylindrical portion, the upper cylindrical portion having a flanged surface positioned in the interior chamber, the sealing surface resting upon the flanged surface, the upper cylindrical portion having an edge portion extending downward past a lower surface of the upper cylindrical portion, forming a recess, configured for a neck of a balloon be stretched over the edge portion with a portion of the neck stored in the recess, the lower cylindrical portion having an arcuately-shaped end component, the arcuately-shaped end component extending downward past a lower surface of the lower cylindrical portion, an aperture formed between the arcuately-shaped end component and the lower surface of the lower cylindrical portion, the string configured to pass through the recess wherein the length passed through the recess is tied into a knot, a cover piece, the cover piece having a protrusion, the protrusion configured to be received on an indent on an inner surface of the upper cylindrical portion wherein the cover piece is snap fit onto the upper cylindrical portion, the cover pierce having a disc shaped component with a series of holes passing through the disc shaped component.

The preceding and following embodiments and descriptions are for illustrative purposes only and are not intended to limit the scope of this disclosure. Other aspects and advantages of this disclosure will become apparent from the following detailed description.

BRIEF DESCRIPTION OF DRAWINGS

The present invention will be described by way of exemplary embodiments, but not limitations, illustrated in the accompanying drawings in which like references denote similar elements, and in which.

DETAILED DESCRIPTION

Figure 1A:
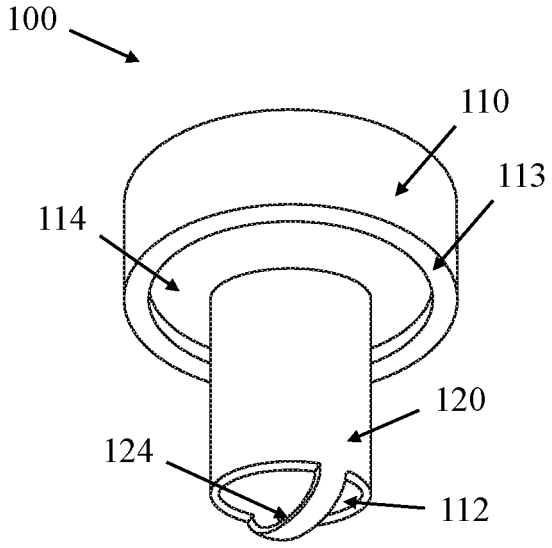
FIG. 1A is an illustration of a front perspective view of an embodiment of a balloon valve in accordance with the present invention.
Figure 1B:
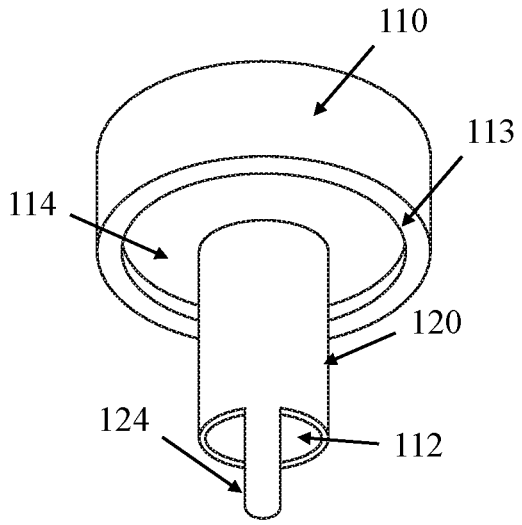
FIG. 1B is a side perspective view of the balloon valve.
Figure 1C:
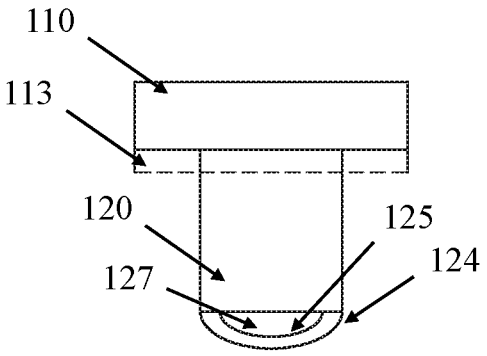
FIG. 1C is a front view of the balloon valve.
Figure 1D:
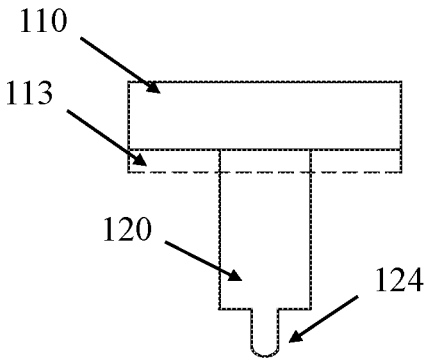
FIG. 1D is a side view of the balloon valve.
Figure 1E:
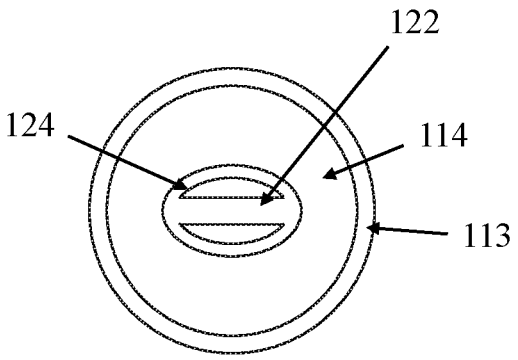
FIG. 1E is a bottom view of the balloon valve.
Figure 1F:
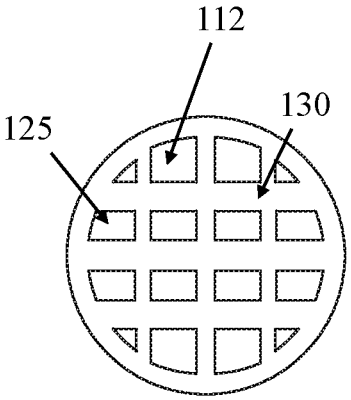
FIG. 1F is a top view of the balloon valve.

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, among others, are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

The present disclosure is generally directed to a system and method of use, according to one or more exemplary embodiments, for a self-sealing balloon valve capable of being filled by any individual including a child. The valve may be removably positioned and secured inside the neck of a balloon. The valve is designed to be inflated with minimum pressure utilizing an umbrella valve situated on an interior surface of the valve allowing for one way air flow, thus maintaining the air inside of the balloon for prolonged periods of time.

With reference now to FIG. 1A-1F, one exemplary embodiment of the balloon valve, balloon valve 100 according to the present invention is generally designated. Balloon valve 100 may include a cylindrically tubular upper section 110 having a relatively larger diameter head terminating in an outlet port 112 and a cylindrically tubular lower section 120 having generally a reduced diameter neck. Upper section 110 may have a circumferential lowered plane edge portion 113 extending past the lower surface of upper section 110. Edge portion 113 surrounds a formed recess 114 between edge portion 113 and the lower surface of upper section 110. Edge portion 113 acts as a shoulder for receiving the neck of a balloon whereby the neck of the balloon is stretched and pulled over edge portion 113 such that when the neck is stretched over, it is secured in recess 114. Upper section 110 may have an indent 119 along the interior surface of the sidewalls of upper section 110 for receiving a cover piece 130.

Figure 2A:
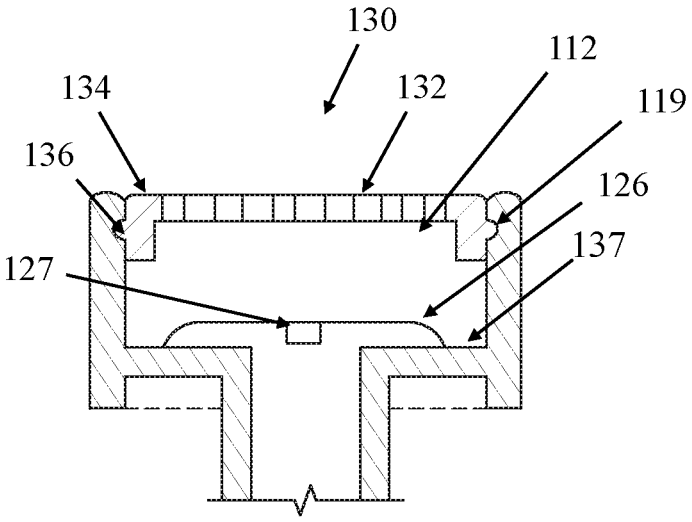
FIG. 2A is a front view of the balloon valve showing the interlocking components of the balloon valve and the cover piece and the umbrella valve insert.
Figure 2B:
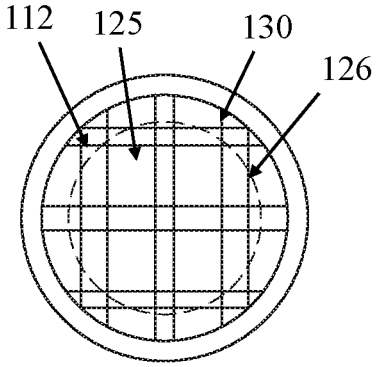
FIG. 2B is a top view of the umbrella valve insert.

Cover piece 130 may have a cylindrical disc portion 132 with a circumferential lowered plane edge portion 134 extending downward past the lower surface of disc portion 132, as illustrated in FIG. 2A-2B. Edge portion 134 may have a circular protrusion 136 on the outer periphery whereby protrusion 136 is configured to be retained in indent 119 of upper section 110. The configuration between indent 119 and protrusion 136 allows cover piece 130 to engage mechanically with upper section 110. This engagement applies a radial inward force that prevents exiting of air from upper section 110 unless through cover piece 130. Cover piece 130 may be removed by applying a force greater than the radial force, such as by a user pulling cover piece 130 away from upper section 110.

Disc portion 132 may have a series of holes 135 through the upper surface and lower surface of disc portion 132 made from a series of horizontal and vertical lines between the outer periphery of disc portion 132. Holes 135 are shown as basket weaved or square in shape, however, the shapes may include: all of, a mixture of, or any manner of derivation of, rectangular, circular, oval, trapezoidal, triangular shapes, arranged in all manner of patterns.

Lower section 120 may expand downward into an inlet port 122 comprising an oval opening acting as a mouthpiece. The oval shaped mouthpiece is an improvement over existing mouthpieces because the oval shape does not have any sharp edges and conforms easier to the mouth of a user. Lower section 120 may terminate an in arcuately-shaped end portion 124 with an arcuately-shaped top surface facing the oval opening and an arcuately shaped bottom surface that faces away from the opening. Arcuately-shaped end portion 124 and lower section 120 may inherently form a channel 127 whereby a string such as string 138 or other fastener may be positioned through channel 127.

String 138, once threaded or looped through channel 127, has sufficient length to allow a length of string 138 extending out of the channel to be tied by a user. String 138 may have round cross-section and in some non-limiting embodiments be manufactured from a plurality of strands that are wound together. String 138 may be made of a cotton material or multiple strands of cotton; however this is non-limiting and string 138 may be made from a single strand/member, have a different thickness, or be made from a different material such as but not limited to a polyester material or rubber material.

Balloon valve 100 may have an inner chamber or empty space that extends between upper section 110 to lower section 120 whereby inlet port 122 is in communication with outlet port 112 such that air entering through inlet port 122 can reach and exit through outlet port 112. Upper section 110 may have an interior flange 137 be used to position and hang umbrella valve insert 126 in its correct position within upper section, as illustrated in FIG. 2A-2B. Umbrella valve insert 126 allows flow in one direction and check flow in the opposite direction. Umbrella valves insert 126 may have elastomeric components such as a diaphragm shaped sealing disk. These elastomeric components may be used as sealing elements in backflow prevention.

When mounted in flange of upper section, the convex diaphragm flattens out against the valve seat and creates a certain sealing force. Umbrella valve insert 126 may have central stem 128 to hold the component of umbrella valve insert 126 in place. Umbrella valve insert 126 allows forward flow once the pressure from exhalation of a user creates enough force to lift the convex diaphragm and the interior flange 137 and so it will allow flow at a predetermined pressure in one way from inlet port 122 and prevent back flow immediately in the opposite way from the balloon.

Figure 3:
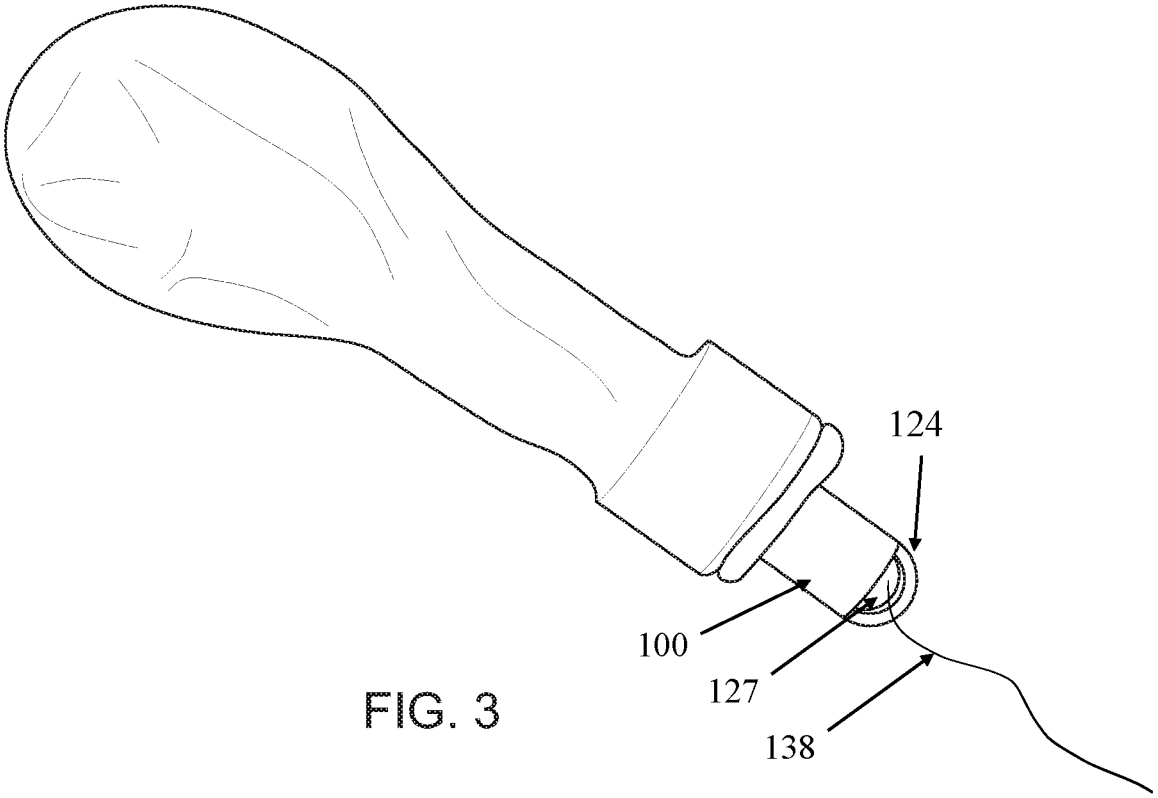
FIG. 3 is an illustration of a balloon connected to the balloon valve.
Figure 4:
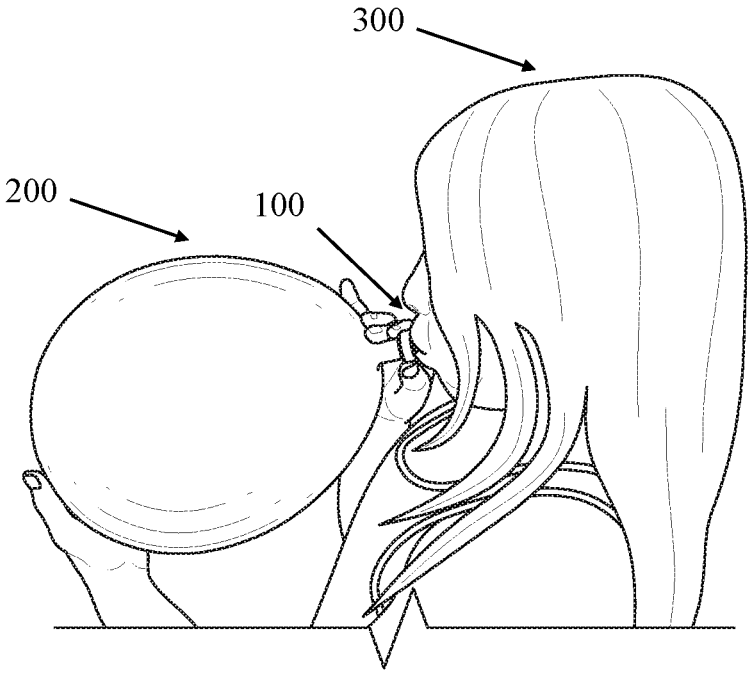
FIG. 4 is an illustration of a user blowing air through the balloon valve into the balloon.

When it is desired to add air to the balloon, balloon valve 100 may be positioned inside the neck of balloon, as illustrated in FIG. 3. Once positioned, user 300 may then begin to exhale air from their lungs into inlet port 122 whereby air is forced towards the inlet port 122 into lower section 120, as illustrated in FIG. 4. Pressure against the bottom of umbrella valve insert 126 is caused by the force of the air moved towards inlet port 122 by the exhalation from the user 300.

As user 300 exhales air from their lungs into the oval mouthpiece, the force on the bottom of umbrella valve insert 126 caused by the air moved from inlet port 122 becomes greater than the force of the air pressure within balloon 200 acting on the top of umbrella valve 126, causing the periphery of umbrella valve insert 126 to disengage from the flange 137 of upper section 110. As a result of this disengagement, the seal between umbrella valve insert 126 and flange 137 is opened, allowing air to be forced through inlet port 122 and into balloon 200. Once user 300 stops exhaling air from their lungs into the oval mouthpiece, the periphery of umbrella valve insert 126 reengages onto flange 137 of upper section 110, preventing air from escaping balloon.

The foregoing description of the invention has been presented for purposes of illustration and description and is not intended to be exhaustive or to limit the invention to the precise form disclosed. Many modifications and variations are possible in light of the above teaching. The embodiments were chosen and described to best explain the principles of the invention and its practical application to thereby enable others skilled in the art to best use the invention in various embodiments and with various modifications suited to the use contemplated.

What is claimed is:

1. A balloon valve system, comprising:

a balloon having a neck at the distal end of the balloon; and a valve, the valve comprising an elastic cap having a sealing surface;

the valve having an upper cylindrical portion and a lower cylindrical portion, the upper cylindrical portion having an air outlet on an upper surface of the upper cylindrical portion, the lower cylindrical portion having an air inlet on a lower surface of the lower cylindrical portion, the valve having an interior chamber extending between the upper cylindrical portion and the lower cylindrical portion configured so air passes through the air inlet to the air outlet;

the valve having a circular edge portion extending downward past a lower surface of the upper cylindrical portion and an upper surface of the lower cylindrical portion, the inside surface of the edge portion, the lower surface of the upper cylindrical portion, and an external surface of the lower cylindrical portion forming a recess, the neck of the balloon configured to be stretched over an external surface of the edge portion and stored into the recess wherein an end of the neck and a length of the neck is stored in the recess, the lower cylindrical portion having a wide arch component, the wide arch component extending across a lower surface of the lower cylindrical portion, an aperture formed between the wide arch component and the lower surface of the lower cylindrical portion, the wide arch component having a top surface facing the air inlet and a bottom surface facing away from the air inlet, wherein the wide arch component is configured such that the user is permitted to properly position their mouth on the valve and blow the air into the air inlet.

2. The balloon valve system of claim 1, wherein the air inlet is oval in shape.

3. The balloon valve system of claim 2, the upper cylindrical portion having a flanged surface positioned in the interior chamber, the sealing surface resting upon the flanged surface.

4. The balloon valve system of claim 1 further comprising, a string, the string configured to pass through the aperture wherein a length passed through the aperture is tied into a knot.

5. The balloon valve system of claim 1, further comprising a removable cover piece, the cover piece having a protrusion, the protrusion configured to be received on an indent on an inner surface of the upper cylindrical portion wherein the cover piece is snap fit onto the upper cylindrical portion, when removed the cover piece permitting the replacement of the valve.

6. The balloon valve system of claim 5, the cover piece having a disc shaped component with a series of holes passing through the disc shaped component, the disc shaped component having a basket weaved pattern.

7. A balloon valve system, comprising:

a valve, the valve comprising an umbrella valve insert, the valve having an upper cylindrical portion and a lower cylindrical portion, the upper cylindrical portion having an air outlet on an upper surface of the upper cylindrical portion, the lower cylindrical portion having an air inlet on a lower surface of the lower cylindrical portion, the valve having an interior chamber extending between the upper cylindrical portion and the lower cylindrical portion configured so air passes through the air inlet to the air outlet, the lower cylindrical portion of a smaller diameter than the upper cylindrical portion, the upper cylindrical portion having a flanged surface positioned in the interior chamber, the umbrella valve insert resting upon the flanged surface;

the valve having a circular edge portion extending downward past a lower surface of the upper cylindrical portion and an upper surface of the lower cylindrical portion, the inside surface of the edge portion, the lower surface of the upper cylindrical portion, and an external surface of the lower cylindrical portion forming a recess, the neck of the balloon configured to be stretched over an external surface of the edge portion and stored into the recess wherein an end of the neck and a length of the neck is stored in the recess, the lower cylindrical portion having a wide arch component, the wide arch component extending across a lower surface of the lower cylindrical portion, an aperture formed between the wide arch component and the lower surface of the lower cylindrical portion, the wide arch component having a top surface facing the air inlet and a bottom surface facing away from the air inlet, wherein the wide arch component is configured such that the user is permitted to properly position their mouth on the valve and blow the air into the air inlet.

8. The balloon valve system of claim 7, further comprising a removable cover piece, the cover piece having a protrusion, the protrusion configured to be received on an indent on an inner surface of the upper cylindrical portion wherein the cover piece is snap fit onto the upper cylindrical portion, when removed the cover piece permitting the replacing of the valve.

9. The balloon valve system of claim 8, the cover pierce having a disc shaped component with a series of holes passing through the disc shaped component.

10. The balloon valve system of claim 9, the umbrella valve insert having a central stem to hold the umbrella valve insert in place.

* * * * *